US011191356B2

(12) United States Patent
Chilcott et al.

(10) Patent No.: US 11,191,356 B2
(45) Date of Patent: Dec. 7, 2021

(54) FRUIT HOLDER

(71) Applicants: Aiden Jack Chilcott, Yallah (AU); Arthur Neil Chilcott, Yallah (AU)

(72) Inventors: Aiden Jack Chilcott, Yallah (AU); Arthur Neil Chilcott, Yallah (AU)

( * ) Notice: Subject to any disclaimer, the term of this patent is extended or adjusted under 35 U.S.C. 154(b) by 0 days.

(21) Appl. No.: 17/182,668

(22) Filed: Feb. 23, 2021

(65) Prior Publication Data

US 2021/0307510 A1 Oct. 7, 2021

Related U.S. Application Data

(63) Continuation of application No. 16/839,522, filed on Apr. 3, 2020.

(51) Int. Cl.

| | |
|---|---|
| ***A47B 75/00*** | (2006.01) |
| ***A47F 7/00*** | (2006.01) |
| ***A47F 5/08*** | (2006.01) |

(52) U.S. Cl.

CPC ..... *A47B 75/00* (2013.01); *A47F 5/08* (2013.01); *A47F 7/0071* (2013.01)

(58) Field of Classification Search

CPC .. A47F 7/0071; A47F 5/04; A47F 5/08; A47F 5/0815; A47F 7/283; A47G 1/06; A47G 1/0616; A47G 1/12; A47G 19/30; A47G 2400/06; A47J 47/16; A47J 37/0786; A47B 75/00; B65D 85/34; B65D 81/365; F26B 9/003; F26B 9/066; G09F 1/12; A23B 7/0205; A23L 3/40; A23N 15/02

USPC ..... 211/85.4, 85.2; D6/681, 681.2, 682, D6/682.1, 682.2, 702, 512, 553, 557, 332, D6/672, 673, 674, 675, 675.1; D11/131, D11/132, 133, 139, 157, 184; D07/702, D07/628, 601

See application file for complete search history.

(56) References Cited

U.S. PATENT DOCUMENTS

| | | | | | |
|---|---|---|---|---|---|
| 1,089,290 | A | * | 3/1914 | Thompson | F16M 11/00 248/165 |
| 2,066,478 | A | * | 1/1937 | Lewin, Jr. | A47F 5/10 211/206 |
| 2,565,700 | A | * | 8/1951 | Schiller | A47F 5/04 428/19 |
| D178,383 | S | * | 7/1956 | Katz | D11/84 |

(Continued)

FOREIGN PATENT DOCUMENTS

| | | | |
|---|---|---|---|
| CN | 201254041 | * | 6/2009 |
| CN | 202800937 | * | 3/2013 |

OTHER PUBLICATIONS

"Vintage Metal Tree of Life Wall Art Made in USA", Jul. 13, 2017, Buddha Groove, https://web.archive.org/web/20170713192854/https://www.buddhagroove.com/vintage-metal-tree-of-life-wall-art-made-in-usa/ (Year: 2017).*

*Primary Examiner* — Jonathan Liu
*Assistant Examiner* — Devin K Barnett
(74) *Attorney, Agent, or Firm* — Eric Karich; Karich & Associates

(57) ABSTRACT

A fruit holder has a base that includes an upwardly extending trunk, and a plurality of branches that extend outwardly from the upwardly extending trunk, at least one first branch being spaced from at least one second branch from the plurality of branches by a distance that is at least 100 mm. Each first branch forms a top surface adjacent each fruit receiving space that has a thickness of at least 50 mm.

4 Claims, 3 Drawing Sheets

(56) References Cited

U.S. PATENT DOCUMENTS 2,905,328 A * 9/1959 Munao ..... A47F 7/02 211/85.2
3,424,313 A * 1/1969 Feibelman ..... A47F 7/143 211/85.2
3,682,421 A * 8/1972 Spiegel ..... A47G 33/12 248/523
3,905,140 A * 9/1975 Damiano ..... G09F 27/00 40/409
4,094,085 A * 6/1978 Nolan, Jr. ..... A47G 1/065 40/490
4,244,128 A * 1/1981 Russell ..... G09F 1/12 40/789
D270,882 S * 10/1983 Wilson ..... 428/18
D273,312 S * 4/1984 Guertin ..... D11/118
D276,055 S * 10/1984 Guertin ..... D11/118
D290,558 S * 6/1987 Zorrilla ..... D6/682.5
4,685,785 A * 8/1987 Mundt ..... G03B 21/64 353/120
D300,790 S * 4/1989 Beckwith ..... D11/131
4,936,466 A * 6/1990 Nava ..... A47F 7/02 206/566
5,043,193 A * 8/1991 Ueda ..... A41G 1/007 428/18
5,050,745 A * 9/1991 Sanders ..... A47F 7/02 211/85.2
5,054,624 A * 10/1991 Camp ..... A47F 5/02 211/85.2
5,176,263 A * 1/1993 Caruso ..... A47F 7/02 206/495
5,246,374 A * 9/1993 Boodram ..... A47G 1/065 40/730
5,269,083 A * 12/1993 Vampatella ..... A47G 1/065 248/206.5
D365,249 S * 12/1995 Reisman ..... D7/601
5,487,600 A * 1/1996 Griffin ..... A47F 3/10 211/129.1
D367,153 S * 2/1996 Sturm ..... D6/674
5,771,790 A * 6/1998 Barrows ..... A23B 7/144 211/113
5,971,172 A * 10/1999 Cockerham ..... A47G 33/06 211/181.1
6,015,218 A * 1/2000 Snell ..... B44F 3/00 362/235
6,557,377 B1 * 5/2003 Massari ..... A44C 17/0216 40/711
6,615,525 B1 * 9/2003 Chang ..... A47G 1/142 40/745
6,854,609 B1 * 2/2005 Hettinger ..... A47F 7/0071 211/85.4
D530,522 S * 10/2006 Phillips ..... D6/302
D610,370 S * 2/2010 Quan ..... D6/681.3
D616,254 S * 5/2010 Goodman ..... D7/601
D637,043 S * 5/2011 Baquero ..... D7/601
D665,197 S * 8/2012 Allameh ..... D6/661.3
D702,245 S * 4/2014 Susman ..... D14/453
D713,155 S * 9/2014 Fugere ..... D6/302
D729,526 S * 5/2015 Klatt ..... D6/306
D748,923 S * 2/2016 Amerongen ..... D6/302
D773,338 S * 12/2016 Trevino ..... D11/118
D830,719 S * 10/2018 Palumbo ..... D6/404
D831,372 S * 10/2018 Palumbo ..... D6/404
D883,037 S * 5/2020 Stachurski ..... D7/601
D899,960 S * 10/2020 Zhao ..... D11/84
10,806,276 B1 * 10/2020 Chargois ..... A47F 7/0071
10,806,277 B1 * 10/2020 Chargois ..... A47F 7/0078
2003/0192840 A1 * 10/2003 Hoyle ..... A47F 5/05 211/85.2
2005/0037157 A1 * 2/2005 Hsu ..... A47G 33/06 428/18
2006/0065613 A1 * 3/2006 McKay ..... A47F 7/02 211/85.2
2006/0168863 A1 * 8/2006 Bartholomew ..... G09F 7/18 40/727
2008/0028657 A1 * 2/2008 Holmes ..... A47G 1/143 40/748
2008/0251413 A1 * 10/2008 Blumenau-Bebry .. A47G 23/06 206/562
2009/0127138 A1 * 5/2009 Allameh ..... A47F 7/02 206/6.1
2009/0273543 A1 * 11/2009 McVinney ..... H04N 1/00973 345/60
2010/0050491 A1 * 3/2010 Grange ..... B44C 5/02 40/735
2011/0220599 A1 * 9/2011 Siahpush ..... A47G 23/0616 211/85.4
2012/0144708 A1 * 6/2012 Schwartz ..... G09F 7/10 40/611.01
2013/0025193 A1 * 1/2013 Stafford ..... A01G 3/04 47/8
2013/0168342 A1 * 7/2013 Yatscoff ..... A47F 5/04 211/85.2
2015/0296979 A1 * 10/2015 Todd ..... A47B 75/00 211/85.4
2015/0321044 A1 * 11/2015 English ..... A63B 21/072 248/415
2015/0327674 A1 * 11/2015 Stevens ..... A47G 29/00 211/85.4
2017/0105551 A1 * 4/2017 Forrest ..... A47G 1/06
2017/0213372 A1 * 7/2017 Boodram ..... H04N 1/00167
2018/0372455 A1 * 12/2018 Klassen ..... F41H 5/013
2020/0054152 A1 * 2/2020 Battin ..... A47B 75/00

* cited by examiner

FRUIT HOLDER

CROSS-REFERENCE TO RELATED APPLICATIONS

This application for a utility patent is a continuation-in-part of a previously filed utility patent, currently pending, having the application Ser. No. 16/839,522, filed Apr. 3, 2020.

FIELD OF THE INVENTION

This invention relates generally to fruit holders, and more particularly to a fruit holding device that has branches that allow for all fruit held by the fruit holder to be visible and receive airflow.

DESCRIPTION OF RELATED ART

The prior art shows many examples of fruit holders and fruit bowls. For example, a typical fruit bowl is shown in Goodman, U.S. D616,254. This lumps all of the fruit into a pile, potentially causing bruising and increased spoilage. This type of bowl also takes up a considerable amount of space on a shelf, bench, countertop, etc.

A hook type device for hanging bananas is shown in Baquero, U.S. D637,043. While this functions to suspend the bananas, it cannot accommodate other pieces of fruit, and it also takes up considerable space.

The prior art teaches fruit bowls and fruit hangers for holding fruit. However, the prior art does not teach a fruit holder that includes branches that form fruit receiving spaces therebetween which separate pieces of fruit such that the fruit is visible and receives airflow. The prior art also does not teach a construction that can be mounted on or adjacent a wall so that very little countertop/bench/shelf space is required. The present invention fulfills these needs and provides further advantages as described in the following summary.

SUMMARY OF THE INVENTION

The present invention teaches certain benefits in construction and use which give rise to the objectives described below.

The present invention provides a fruit holder for holding a plurality of pieces of fruit. The fruit holder includes a base that includes an upwardly extending trunk; a plurality of branches that extend outwardly from the upwardly extending trunk, at least one first branch being spaced from at least one second branch from the plurality of branches by a distance that is at least 100 mm; and wherein each first branch forms a top surface adjacent each fruit receiving space, each top surface having a thickness of at least 50 mm.

A primary objective of the present invention is to provide a fruit holder having advantages not taught by the prior art.

Another objective is to provide a fruit holder that may be mounted on or adjacent a wall so that very little countertop/bench/shelf space is required.

Another objective is to provide a fruit holder that includes branches that form fruit receiving spaces therebetween which separate pieces of fruit such that the fruit is visible and receives airflow.

A further objective is to provide a fruit holder that includes at least one notch for holding fruit from a stalk or stem.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above-described drawing figures illustrate the invention, a fruit holder 10 for holding a plurality of pieces of fruit 12.

Figure 1:
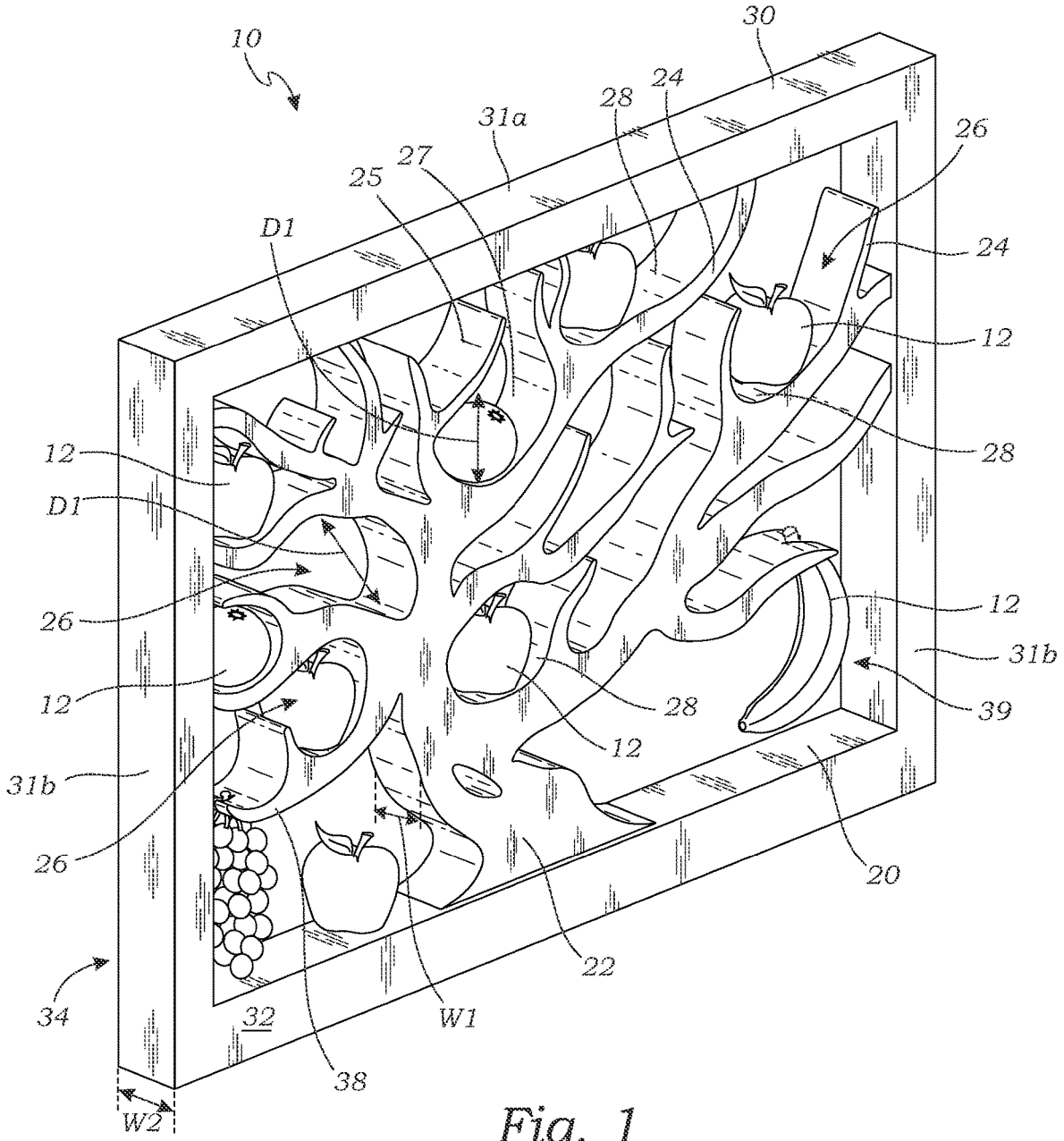
FIG. 1 is a perspective view of a fruit holder according to one embodiment of the present invention.

FIG. 1 is a perspective view of the fruit holder 10 according to one embodiment of the present invention, shown holding the plurality of pieces of fruit 12. As shown in FIG. 1, the fruit holder 10 comprises a base 20 that includes an upwardly extending trunk 22, and a plurality of branches 24 that extend outwardly from the upwardly extending trunk 22. At least one first branch 25 is spaced from at least one second branch 27 by a distance D1 that is great enough to form a fruit receiving space 26 that is sized and shaped to accommodate at least one of the pieces of fruit 12. D1 is at least 100 mm, but may vary significantly to accommodate desired pieces of fruit 12.

At least some of the branches 24 form a top surface 28 adjacent the fruit receiving space 26 that has a thickness W1 and a shape adapted for holding at least one of the pieces of fruit 12 in the space formed between the branches 24. As illustrated in FIG. 1, the fruit receiving spaces 26 allow for the plurality of pieces of fruit 12 to be spaced apart so that each piece is visible, and no fruit is bruised by the weight of other fruit on top of it. W1 should be at least 50 mm, in this embodiment 60 mm. The fruit receiving spaces 26 further allow airflow around each piece of fruit 12.

The fruit holder 10 may further comprise a frame perimeter 30 that is attached to the base 20, and surrounds the plurality of branches 24. The frame perimeter 30 has a front surface 32 and a rear surface 34, and may include the base 20 as a bottom frame component, and further has a top frame component 31*a* and two opposed side frame components 31*b*. The frame perimeter 30 may be generally rectangular in shape, or it may have another shape (e.g., another geometric shape, or an irregular or custom shape, as desired by one skilled in the art of product design. The frame perimeter 30 may be adapted to be hung on a wall, as discussed in greater detail below. Alternatively, the frame perimeter 30 may be thick enough to support itself on a counter surface, or to abut an adjacent wall or other structure.

In some embodiments, the frame perimeter 30, the upwardly extending trunk 22, and the plurality of branches 24, form a single integral construction. The frame perimeter has a width W2 that is at least 2 mm greater than W1, in this embodiment approximately 63 mm. In other embodiments, the frame perimeter 30 may be any width capable of supporting the upwardly extending trunk 22 and the branches 24. In this embodiment, the frame perimeter 30 and the plurality of branches 24 each form a generally planar structure for holding the pieces of fruit 12; however, many alternative designs may also be used, and at least some of the branches or other structure may extend forwardly or rearwardly, according to the needs of the consumer.

In some embodiments, the holder 10 may be used to hold other items, e.g., vegetables, other food products, Christmas decorations, Easter eggs, etc., or any other item desired by the user.

Figure 2:
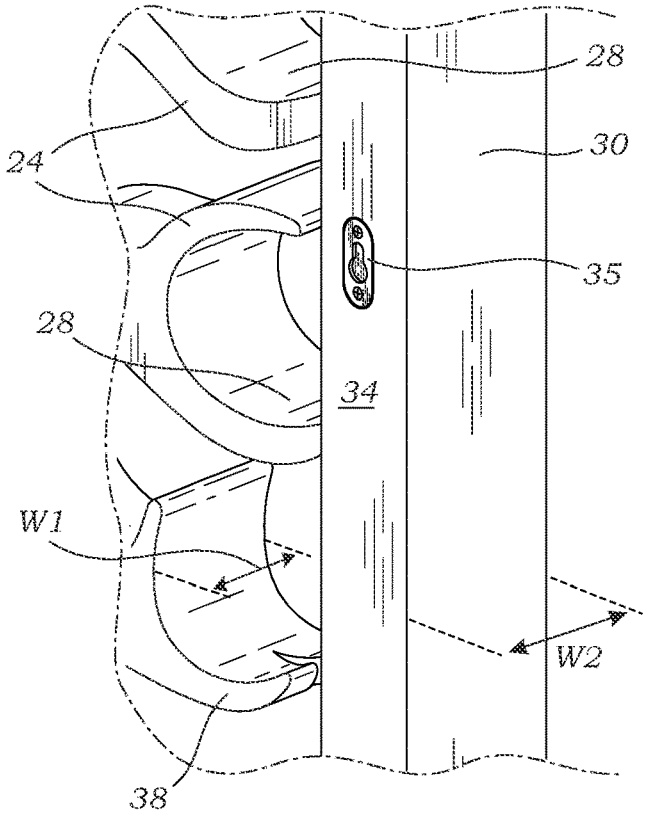
FIG. 2 is an up-close view of a wall attachment piece of the fruit holder.

FIG. 2 is an up-close view of a wall attachment piece 35 mounted on the rear surface 34 of the fruit holder 10, in this case on the frame perimeter 30, although it may be mounted on branches or other components of the holder 10. In this embodiment, the wall attachment piece 35 is in the form of a keyhole mount located on either side of the rear surface 34 of the frame perimeter 30; however, in other embodiments, the wall attachment piece 35 may be in the form of any type of mount known in the art, e.g., mechanical fastener, non-mechanical fasteners (e.g., adhesives, magnets, etc.), or any other fastener known in the art.

The fruit holder 10 may further be adapted to be mounted on a wall via other means, e.g., the frame perimeter 30 may be formed to hang on an edge, or held by a receiver of the wall structure (not shown), etc.

Figure 3:
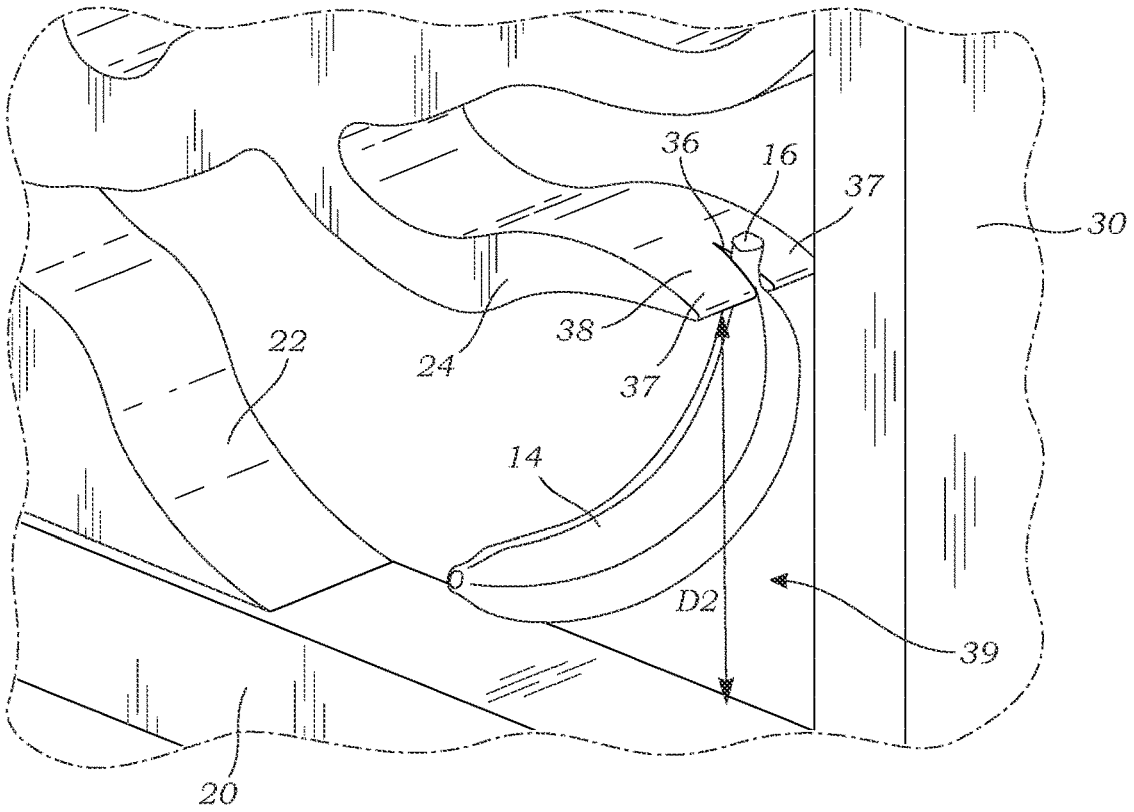
FIG. 3 is an up-close view of a notch on a branch of the fruit holder, shown holding a piece of fruit.

FIG. 3 is an up-close view of a notch 36 on one of the plurality of branches 24 of the fruit holder 10, shown holding a banana 14 having a stem 16. In this embodiment, at least some of the plurality of branches 24 each extend to an end 38 that includes the notch 36 adapted for hanging the pieces of fruit 12 therefrom. In this embodiment, the notches 36 are cut into the lowermost branches 24 to form two adjacent prongs 37, to provide space for engaging the fruit 12 so that the fruit 12 hangs within a fruit receiving area 39. However, in other embodiments, the notches 36 may be in any desired branch, as deemed suitable by the manufacturer. The notch 36 may typically hold fruit that has a stalk 16 or suitable stem, e.g., bananas, grapes, cherries, etc. The notch 36 is spaced a distance D2 from the base 20 that is at least 6 inches.

Figure 4:
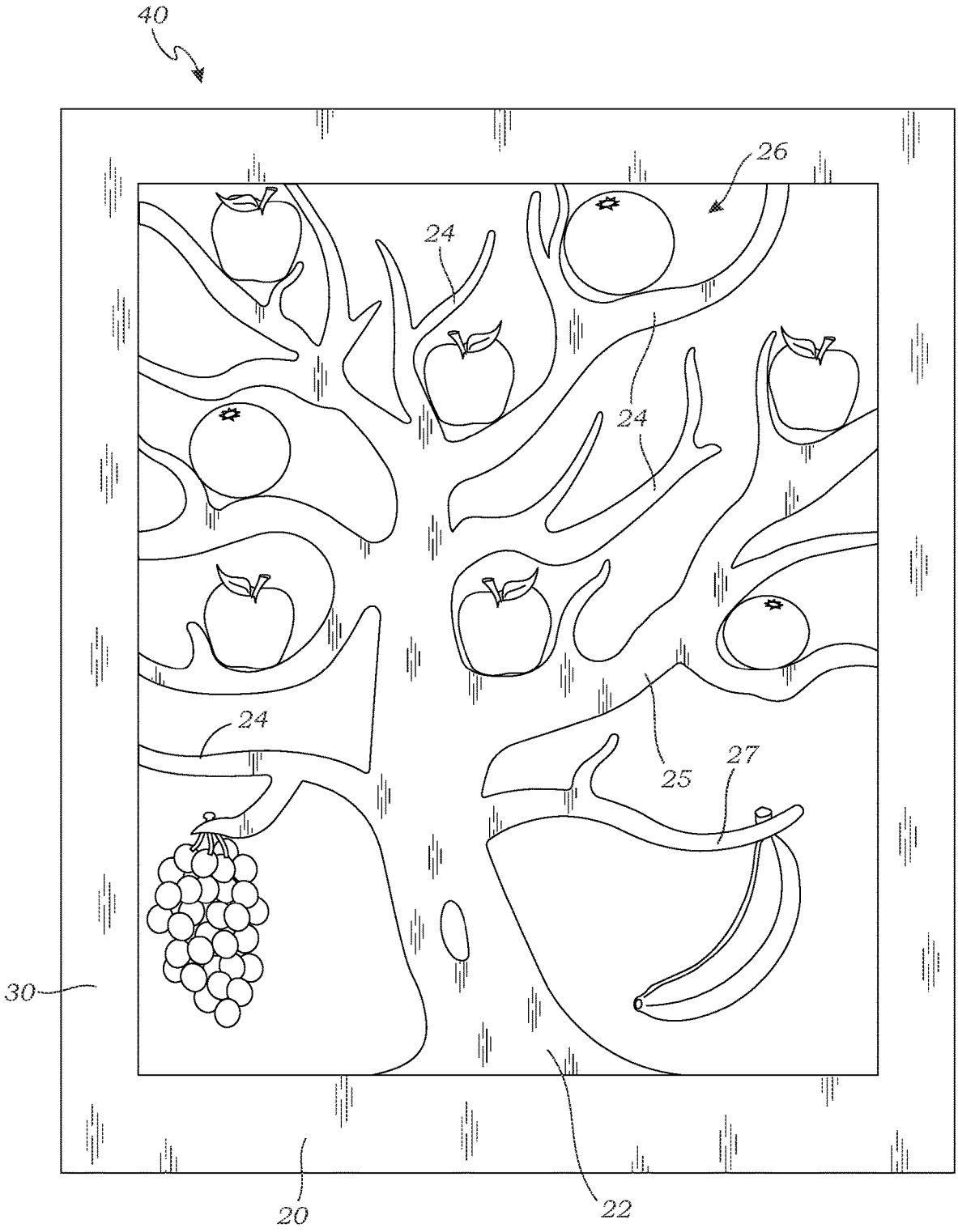
FIG. 4 is a front elevational view of a fruit holder according to a second embodiment of the present invention.

FIG. 4 is a front elevational view of a fruit holder 40 according to a second embodiment of the present invention. As shown in FIG. 4, the frame perimeter 30 may be produced in various orientations, sizes, and shapes (e.g., rectangular as shown, or alternatively round, oval, triangular, or any other geometric shape, or any irregular shape or custom design, etc.). The upwardly extending trunk 22 and plurality of branches 24 may be formed in a variety of configurations, as desired to provide artistic appeal and optimal utility. Other possible shapes of the fruit holder 10 may be constructed which are to be considered within the scope of the present invention.

As used in this application, the words "a," "an," and "one" are defined to include one or more of the referenced item unless specifically stated otherwise. The terms "approximately" and "about" are defined to mean +/−10%, unless otherwise stated. Also, the terms "have," "include," "contain," and similar terms are defined to mean "comprising" unless specifically stated otherwise. Furthermore, the terminology used in the specification provided above is hereby defined to include similar and/or equivalent terms, and/or alternative embodiments that would be considered obvious to one skilled in the art given the teachings of the present patent application. While the invention has been described with reference to at least one particular embodiment, it is to be clearly understood that the invention is not limited to these embodiments, but rather the scope of the invention is defined by claims made to the invention.

What is claimed is:

1. A fruit holder for holding a plurality of pieces of fruit, the fruit holder comprising:

a base that includes an upwardly extending trunk;

a plurality of branches that extend outwardly from the upwardly extending trunk, wherein the base and the plurality of branches define a tree, at least one first branch from the plurality of branches being spaced from at least one second branch from the plurality of branches by a distance that is at least 100 mm, to form a fruit receiving space therebetween;

wherein each first branch has a length, width, and a thickness, wherein the thickness of each first branch forms a top surface that faces upwardly towards a bottom of a corresponding second branch and a corresponding fruit receiving space, wherein the top surface of each first branch has a thickness of at least 50 mm to support at least one of the pieces of fruit thereon within the corresponding fruit receiving space between the at least one first branch and the at least one second branch;

a rectangular frame perimeter that is attached to the base and surrounds the tree, wherein substantially the entire tree is within the frame, and the frame is configured to be hung on a wall.

2. The fruit holder of claim 1, wherein the frame perimeter has a width that is at least 2 mm greater than the width of the top surface of each of the plurality of branches.

3. The fruit holder of claim 2, wherein the frame perimeter and the plurality of branches form a generally planar structure.

4. The fruit holder of claim 1, wherein at least some of the plurality of branches each extend to an end that includes a notch adapted for hanging one of the pieces of fruit therefrom.

* * * * *